US007266318B2

(12) United States Patent
Inukai

(10) Patent No.: US 7,266,318 B2
(45) Date of Patent: Sep. 4, 2007

(54) IMAGE-FORMING DEVICE THAT PERFORMS TRANSFER CONDITION CONTROL

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 174 days.

(21) Appl. No.: 11/092,815

(22) Filed: Mar. 30, 2005

(65) Prior Publication Data

US 2005/0220472 A1 Oct. 6, 2005

(30) Foreign Application Priority Data

Mar. 31, 2004 (JP) ..... 2004-103471

(51) Int. Cl.
*G03G 15/16* (2006.01)

(52) U.S. Cl. ..... 399/66

(58) Field of Classification Search ..... 399/66, 399/297, 310

See application file for complete search history.

(56) References Cited

U.S. PATENT DOCUMENTS 6,404,998 B1 * 6/2002 Tanaka et al. ..... 399/66
6,650,861 B2 11/2003 Inukai et al.
6,952,539 B2 * 10/2005 Matsuura ..... 399/66
2001/0028803 A1 * 10/2001 Yoda ..... 399/66
2001/0051055 A1 * 12/2001 Omata et al. ..... 399/66
2004/0131373 A1 * 7/2004 Saito et al. ..... 399/66

FOREIGN PATENT DOCUMENTS

JP A 2002-202671 7/2002
JP 2003241544 A * 8/2003

* cited by examiner

*Primary Examiner*—Susan Lee
(74) *Attorney, Agent, or Firm*—Oliff & Berridge PLC

(57) ABSTRACT

An image-forming device which facilitates, with a simple structure, the realization of suitable transfer condition control in more situations is disclosed. While the transfer voltage applied to a transfer member such as a transfer roller is detected by a transfer voltage detector, the transfer current is detected by a transfer current detector, and these are transmitted to a CPU. The CPU determines the target current which is to be the control target from the transfer voltage and transfer current, and drives a step-up circuit so as to perform constant current control based on the target current which has been determined. By calculating the target current using calculation formulas which differ by transfer voltage range, suitable transfer condition control under more environments and conditions can be realized.

19 Claims, 5 Drawing Sheets

IMAGE-FORMING DEVICE THAT PERFORMS TRANSFER CONDITION CONTROL

BACKGROUND OF THE INVENTION

1. Field of the Invention

The present invention relates to image-forming devices.

2. Description of the Prior Art

An image-forming device employing an electrophotographic process, such as laser printer, forms an image on a recording medium while transferring a toner image formed on a photosensitive drum surface onto the recording medium.

Constant voltage control, in which a constant transfer voltage is maintained, and constant current control, in which a constant transfer current is maintained, are well utilized in order to transfer the toner image formed on the photosensitive drum surface onto the recording medium. On the other hand, the resistance of the recording paper often changes due to humidity changes. When the constant voltage control is utilized, the transfer current is decreased if the resistance is increased. As a result, faulty transfers often occur due to the insufficient transfer current. Accordingly, it is preferable that the constant current control is utilized.

Meanwhile, current flows directly from the transfer roller to the photosensitive drum, when the transfer roller is contact with the photosensitive drum. When the resistance of the recording medium is reduced, the current that flows directly from the transfer roller to the photosensitive drum is increased without charging the recording paper. As a result, faulty transfer occurs due to the insufficient transfer current. In order to resolve this problem, Japanese patent unexamined publication 2002-202671 discloses a technique that assumes that the transfer current flowing directly from the transfer roller to the photosensitive drum is increased when the transfer voltage drops below a prescribed value, and switches from the constant current control to the constant voltage control in order to increase the transfer current.

However, the transfer current flowing directly from the transfer roller to the photosensitive drum is not is increased necessary when the transfer voltage drops below the prescribed value. Therefore, Japanese patent unexamined publication 2002-202671 cannot take desired amount of current to the photosensitive drum necessarily.

SUMMARY OF THE INVENTION

An object of the present invention, which represents the result of taking the problems in question into consideration, is to provide an image-forming device which facilitates, with a simple structure, transfer condition control which is suitable to more situations.

In view of the above-described drawbacks, it is an objective of the present invention to provide an image-forming device capable of controlling a transfer condition with a simple structure corresponding to more situations.

In order to attain the above and other objects, the present invention provides an image-forming device having: an image-bearing body, a transfer unit, a transfer voltage applying unit, a transfer current detection unit, a transfer voltage detection unit, and a control unit. A toner image is capable of being bore on the image-bearing body. The transfer unit faces the image-bearing body. The transfer voltage applying unit applies transfer voltage to the transfer unit so that transfer current flows between the image-bearing body and the transfer unit. The transfer current detection unit detects the transfer current. The transfer voltage detection unit detects the transfer voltage. The control unit determines, based on both the detected transfer voltage and the detected transfer current, target current to be flowed between the image-bearing body and the transfer unit, and controls the transfer current to match the target current while adjusting the transfer voltage output from the transfer voltage applying unit.

The present invention further provides an image-forming device having: an image-bearing body, a transfer unit, a transfer voltage applying unit, a transfer current detection unit, a transfer voltage detection unit, and a control unit. A toner image is capable of being bore on the image-bearing body. The transfer unit faces the image-bearing body. The transfer voltage applying unit applies transfer voltage to the transfer unit so that transfer current flows between the image-bearing body and the transfer unit. The transfer current detection unit detects the transfer current. The transfer voltage detection unit detects the transfer voltage. The control unit determines, based on both the detected transfer voltage and the detected transfer current, target voltage applied between the image-bearing body and the transfer unit, and controls the transfer voltage to match the target voltage while adjusting the transfer voltage output from the transfer voltage applying unit.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
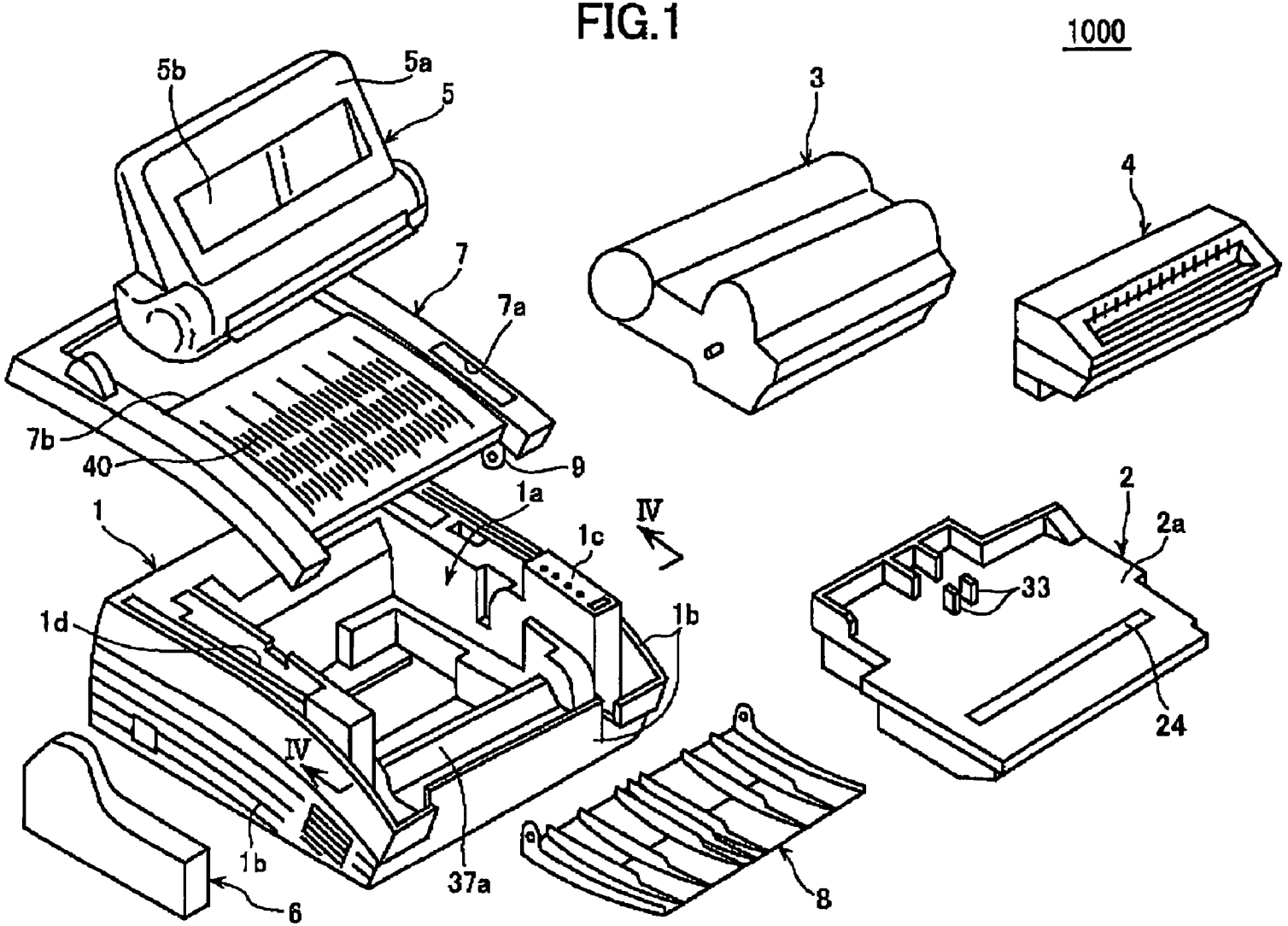
FIG. 1 is a perspective view showing the major structural parts of a laser printer of a preferred embodiment according to the present invention.
Figure 2:
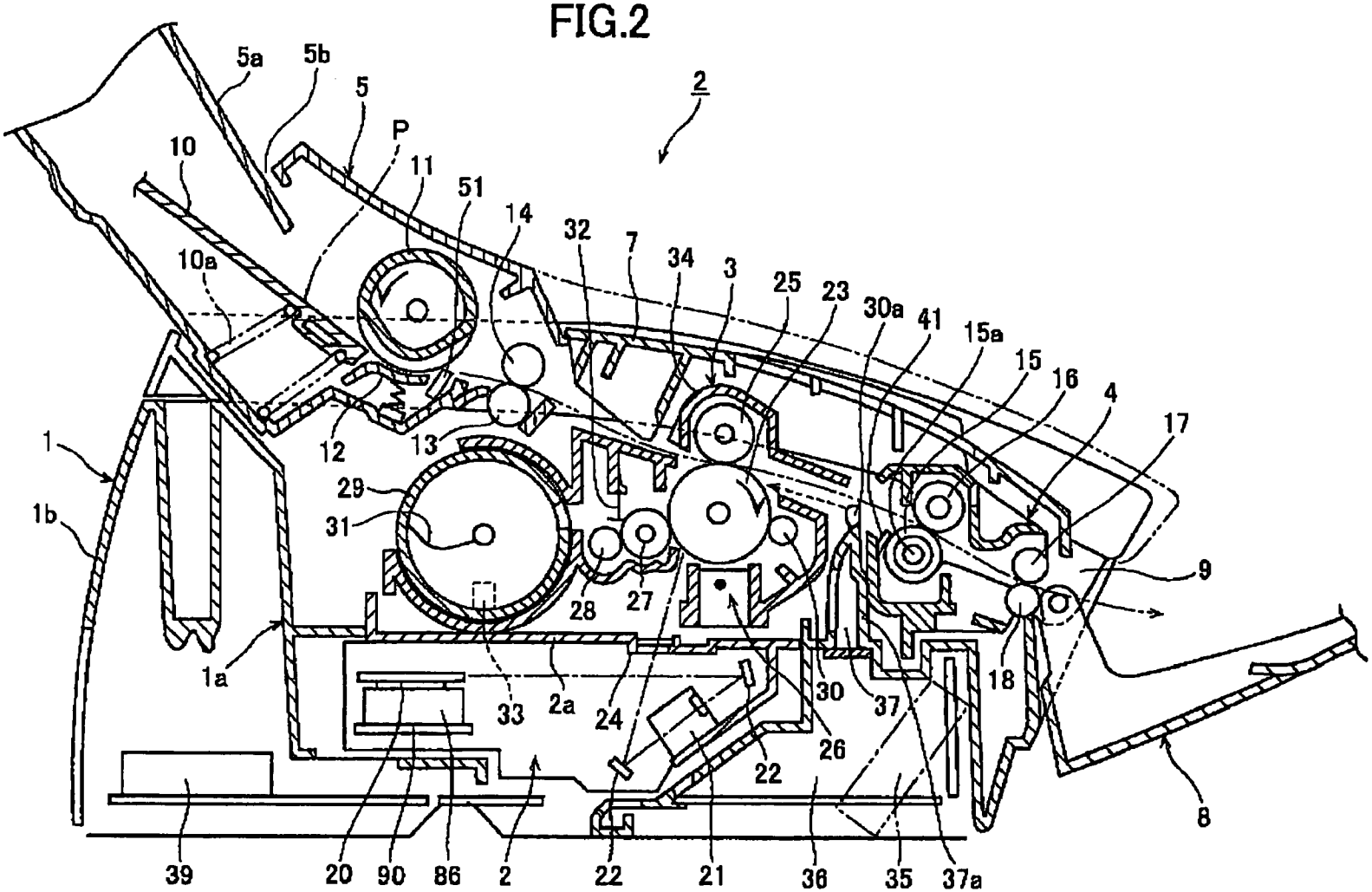
FIG. 2 is a simplified sectional side view of the laser printer.

A laser printer according to a preferred embodiment of the present invention will be described while referring to the accompanying drawings wherein like parts and components are designated by the same reference numerals to avoid duplicating description. FIG. 1 is a perspective view of main components of the laser printer 1000. FIG. 2 is a cross-sectional view of the laser printer 1000.

The laser printer 1000 is provided with a main casing 1, a scanner unit 2, a process unit 3, a fixing unit 4, a paper supply unit 5, a drive unit 6, a top cover 7, a paper delivery tray 8, and a control unit (not shown) to control each unit.

The main casing 1, which is made of plastic, has the main frame 1*a*, a main cover 1*b*, an operating panel 1*c*, and an accommodation recess 1*d*. The main covers 1*b* covers the outer surfaces on all four sides (the front, rear, and left and right sides) of the main frame 1*a*. The main frame 1*a* and the main cover 1*b* are formed integrally by an ejection molding, for example. The operating panel 1*c* protrudes upward from the right side of the main frame 1*a*. The accommodation recess 1*d* is formed in the left side of the main frame 1*a* and the main cover 1*b* formed integrally.

The drive unit 6 includes a main motor and a gear train (not shown). The drive unit 6 is inserted from the lower side of the main casing 1 into an accommodation recess 1*d* and attached thereto.

The top cover 7, which is made of plastic, covers the upper surfaces of the main frame 1*a* and the main cover 1*b*. In the top cover 7, a through-hole 7*a* and a through-hole 7*b* are formed. The through-hole 7*a* passes through the operating panel 1*c*. The through-hole 7*b* passes through the paper supply unit 5. Further, the top cover 7 is provided with brackets 9 that protrude respectively from the left and right sides of the front edge of the top cover 7 (although only one bracket 9 is shown in FIG. 1).

The paper delivery tray 8 is attached to the brackets 9, where the brackets 9 are able to move up and down. When the paper tray 8 is not in use, the paper delivery tray B can be folded up toward the upper surface of the top cover 7.

The paper supply unit 5 is provided with a feeder case 5*a* and a manual insertion opening 5*b*. Within the feeder case 5*a*, recording paper P is set in a stacked state. As shown in FIG. 2, the leading edge of the recording paper P is pressed toward a paper supply roller 11 by a support plate 10, wherein the support plate 10 is pressed toward upper by screws 10*a* within the feeder case 5*a*. Therefore, sheets of the recording paper P can be separated one at a time by a combination of a separation pad 12 and the paper supply roller 11, where the paper supply roller 11 is rotating due to the power transmitted from the drive unit 6. The sheets can be sent on to a pair of upper and lower registration rollers 13 and 14.

The manual insertion opening 5*b* opens diagonally upward of the paper supply unit 5. A recording medium that is different from the recording paper P within the feeder case 5*a* can be inserted into the manual insertion opening 5*b* fox recording.

The process unit 3 forms an image (toner image) by a developer (toner) on the surface of the recording paper P that is sent through the registration rollers 13 and 14.

The fixing unit 4 is provided with a heating roller 15 and a pressure roller 16. The recording paper P on which the toner image is formed is heated while being sandwiched between a heating roller 15 and a pressure roller 16, in order to fix the toner image onto the recording paper P.

The heating roller 15 has a fixing heater 15*a* that is inserted into an aluminum tube coated with fluorine. A substantially central portion of an outer surface of the heating roller 15 is in contact with a thermistor 41. The pressure roller 16 is a rubber roller having a surface covered with a fluoroplastic.

A paper delivery unit is provided with a paper delivery roller 17 and a pinch roller 18 that are disposed on the downstream side within the casing of the fixing unit 4. The paper delivery unit delivers the recording paper P, where the toner image has been fixed, to the paper delivery tray 8. A recording medium conveying path is configured by a portion from the paper supply roller 11 to the paper delivery portion.

An upper support plate 2*a* of the scanner unit 2 is fixed to stays by screws or the like at a part that is below the process unit 3 disposed in a substantially central portion of the main frame 1*a*, where the stays are formed integrally on the upper surface side of the base plate of the main frame 1*a*.

The scanner unit is provided with a light-emitting portion (not shown), a polygon mirror 20, a lens 21, and a reflective mirror 22, on the lower surface side of a plastic upper support plate 2*a*. The polygon mirror 20 is rotated at high speed by a scanner motor 86 driven by a motor drive circuit 90. A laser emitted from the light-emitting portion is deflected by the polygon mirror 20 and passes through a glass plate 24, and exposes the outer peripheral surface of the photosensitive drum 23, where the glass plate 24 covers a long, thin scanner hole, which is pierced through the upper support plate 2*a* so as to extend along the axial line of the photosensitive drum 23.

The process unit 3 is provided with the photosensitive drum 23, a transfer roller 25, a scorotron type of charger 26, a developer device, a removable toner cartridge 29, a cleaning roller 30, and a charge removal lamp 30*a*.

The transfer roller 25 is in rotatable contact with the upper surface of the photosensitive drum 23. The scorotron type charger 26 is disposed below the photosensitive drum 23. The developer device has a developer roller 27 and a supply roller 28, which are disposed on the upstream side of the photosensitive drum 23 in the paper supply direction. The developer (toner) supplier, in other words, a removable toner cartridge 29 is disposed further upstream of the developer device. The cleaning roller 30 is disposed downstream from the photosensitive drum 23. The charge removal lamp 30*a* is disposed further downstream from the cleaning roller 30.

A latent electrostatic image is formed on the outer peripheral surface of the photosensitive drum 23 when the laser beam emitted from the scanner unit 2 is scanned over the surface of the photosensitive drum 23 that has been charge uniformly by the charger 26. The developer (toner) within the toner cartridge 29 has been agitated by an agitator 31 and discharged. Then, the developer (toner) is carried on the outer peripheral surface of the developer roller 27 via the supply roller 28, and the thickness of the toner layer thereon is regulated by a blade 32.

Figure 3:
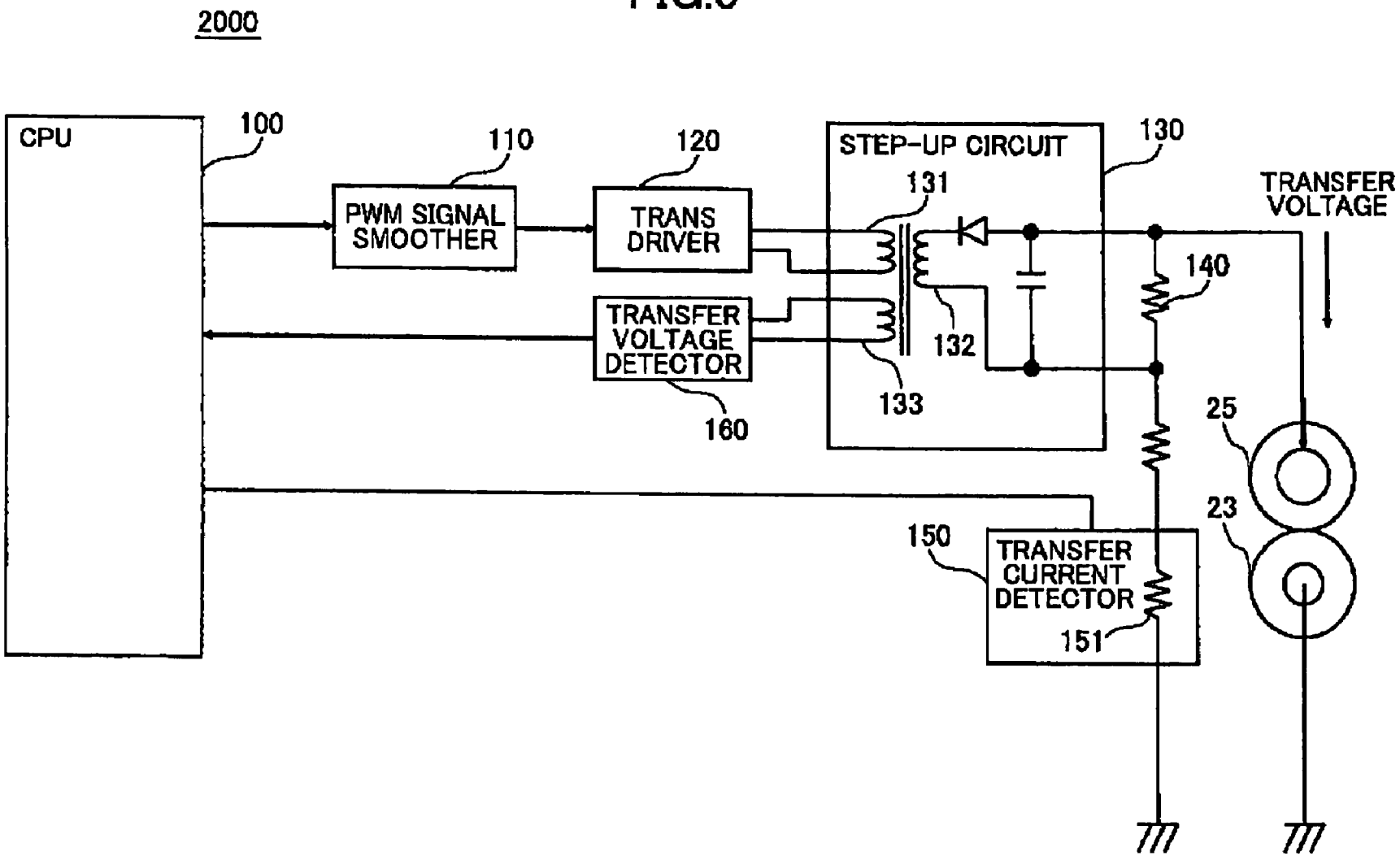
FIG. 3 is a circuit diagram of the transfer voltage controller.

The latent electrostatic image formed on the surface of the photosensitive drum 23 is developed into a visible image when developer from the developer roller 27 adheres to the latent image. The image (toner image) formed by this developer is transferred to the recording paper P that passes between the photosensitive drum 23 and the transfer roller 25 to which is applied a transfer voltage whose potential is opposite to a potential of the photosensitive drum 23. The transfer voltage is controlled by a transfer voltage controller 2000 (FIG. 3). For the control unit (not shown) and the transfer voltage controller 2000, separate CPUs may be utilized or, alternatively, a single CPU may be utilized. The toner remaining on the photosensitive drum 23 is collected temporarily by the cleaning roller 30. The toner corrected is returned to the process unit 3 for re-use.

Note that a toner sensor 33 having a paired light-emitting portion and light-receiving portion is mounted on the upper support plate 2*a* of the scanner unit 2 so as to protrude upward from the upper support plate 2*a*. The toner sensor 33 faces a recess in the lower surface of the toner cartridge 29 in the process unit 3 so that the toner sensor 33 can detect the presence or absence of toner within the toner cartridge 29.

The process unit 3 is formed as a cartridge that is inserted into a plastic case 34. The thus-packaged process unit 3 can be mounted removably in the main frame 1*a*. An accommodation portion 36 for accommodating a cooling fan 35 and a ventilation duct 37 extending in the lateral direction crossing the direction of travel of the recording paper P are connected on a lower surface side linking a forward position of the main frame 1*a* and a forward position of the main cover 1*b*. An upper surface plate 37*a* of the ventilation duct 37 is formed to have an inverted V-shape in section. This upper surface plate 37*a* is positioned between the process unit 3 and the fixing unit 4 to shield the process unit 3 from direct transmission of heat emitted from the heating roller 15 in the fixing unit 4.

The cooling air flow produced by the cooling fan 35 passes through the ventilation duct 37 and is transferred to the lower surface on one side of the main frame 1*a*, and cools a power source 39 at the rear and the main motor within the drive train unit 6. Also, the cooling air flow is blown from a plurality of slits that open on the process unit 3 side so that the cooling air flow passes upward between the process unit 3 and the fixing unit 4, and is exhausted out of the device from a plurality of exhaust holes 40 that pierce through the top cover 7.

Next, the configuration of the transfer voltage controller 2000 that controls the transfer voltage applied to the aforementioned transfer roller 25 will be described. FIG. 3 is a diagram of the configuration of the transfer voltage controller 2000. The transfer voltage controller 2000 is provided with a CPU 100, a PWM signal smoother 110 having a capacitor, a transformer driver 120, a step-up circuit 130 having a transformer including a primary coil 131, a secondary coil 132, and a detection coil 133, a resister 140, a transfer current detector 150 having a resister 151, and a transfer voltage detector 160.

The CPU 100 outputs a transfer voltage control signal to the PWM signal smoother 110, where the transfer voltage control signal indicates the duty ratio to control the transfer voltage. The PWM signal smoother 110 smoothes the transfer voltage control signal and transfers it to the transformer driver 120 as an analog signal. The transformer driver 120 controls the amount of current flowing into the primary coil 131 of the step-up circuit 130 based on the analog voltage.

An electromotive force corresponding to the amount of current flowing into the primary coil 131 is generated at the secondary coil 132, and applied to the roller shaft in the transfer roller 25 as the transfer voltage.

The resister 140 stabilizes the voltage output from the step-up circuit 130. The transfer current detector 150 has a resistor element 151 that detects the amount of the transfer current flowing between the transfer roller 25 and the photosensitive drum 23. The transfer voltage detector 160 detects the transfer voltage applied to the transfer roller 25.

The transfer current value detected by the transfer current detector 150 is sent to the CPU 100. Also, the transfer voltage value detected by the transfer voltage detector 160 is sent to the CPU 100.

The CPU 100 determines a target current based on the transfer current detected by the transfer current detector 150 and the transfer voltage detected by the transfer voltage detector 160 as described later. In the present embodiment, the constant current control, which controls the transfer voltage in order to maintain the constant transfer current, is utilized. Therefore, the CPU 100 outputs the PWM signal to the PWM signal smoother 110 in accordance with the determined target current, where the PWM signal prescribes the amount of current flowing into the primary coil 131 for outputting the transfer voltage.

Figure 4:
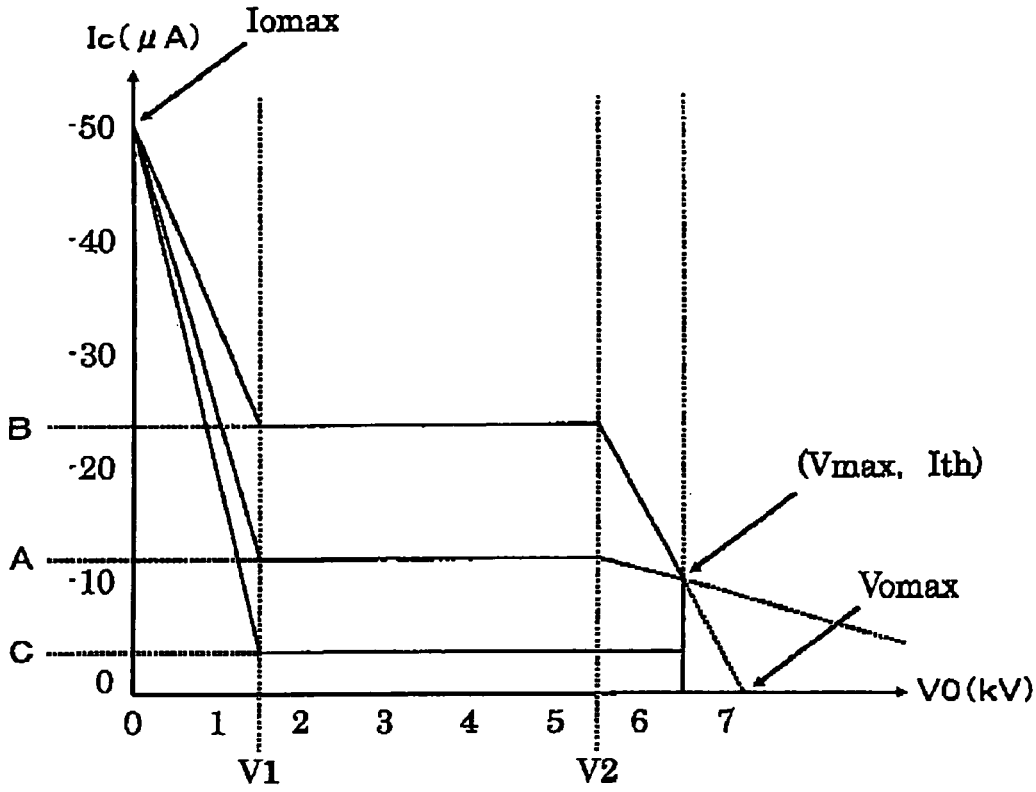
FIG. 4 is a diagram for describing the determination of the target current.

Next, the method that determines the target current from the detected transfer current and transfer voltage will be described referring to FIG. 4. FIG. 4 is an explanatory diagram showing the target current Ic corresponding to the transfer voltage V0.

X-axis indicates the transfer voltage V0 detected by the transfer voltage detector 160, and Y-axis indicates the target current Ic. Each mark A, B, and C indicates the target current Ic in a prescribed voltage range. Any of the mark A, B, and C can be selected based on various settings, such as the size, thickness, and consistency of the recording paper, and whether it is recording paper or overhead projector sheets, for example.

When the transfer voltage V0 is within the range from the first prescribed value V1 (1.5 kV in FIG. 4) to the second prescribed value V2 (5.5 kV in FIG. 4), the target current Ic is maintained at any of the mark A, B, and C while the constant current control is performed.

On the other hand, when the transfer voltage V0 drops below the first prescribed value V1 and when the transfer voltage V0 rises above the second prescribed value V2, the target current Ic should be changed to a value calculated using a prescribed formula.

More specifically, when the transfer voltage V0 drops below the first prescribed value V1, the target current Ic is calculated while applying the detected transfer voltage V0 and the detected transfer current I0 to Formula 1 below, $$Ic = Iomax/(1 - a \times V0/I0) \quad \text{(Formula 1)}$$

Here, the Iomax is a prescribed maximum current that the laser printer 2000 can output, and is shown in FIG. 4 as the target current Ic when the transfer voltage is 0. The "a" represents a slope of a straight line connecting (0, Iomax) and (V1, I1) in FIG. 4, where the V1 is 1.5 kV and the target current I1 indicates any of the A, B, or C. Specifically, the "a" is (I1−Iomax)/V1. In the present embodiment, the V1 is fixed at 1.5 kV, while the target current Ic in the range between 1.5 kV and 5.5 kV (hereinafter referred to "constant current region") is any of the A, B, or C. Therefore, the value of the "a" will also change depending on which of the A, B, and C is selected.

Normally, when a resistance of the recording medium between the transfer roller 25 and the photosensitive drum 23 is reduced, the current that flows directly from the transfer roller 25 to the photosensitive drum 23 is increased without charging the recording medium. In that case, the detected transfer current I0 will not indicate the current charging the recording medium precisely. In the present embodiment, the current charging the recording medium is estimated by experiments based on the detected voltage V0 and the detected current I0, and the formula 1 indicates the proper transfer current Ic based on the current charging the recording medium. Thus, the current Ic is determined properly.

The target current Ic that does not match precisely the target current Ic calculated by the Formula 1 may be utilized. Furthermore, the Formula 1 may be not necessarily utilized. For example, an adjusted Formula 1 can be utilized, or another formula can be utilized.

Meanwhile, when the transfer voltage V0 exceeds the second prescribed value V2, the target current Ic is calculated by Formula 2 below.

$$Ic = Vomax/(V0/I0 - b) \quad \text{(Formula 2)}$$

Here, the "b" represents a slope of a straight line connecting (V2, I2) and (Vmax, Ith) in FIG. 4, where the Vmax is a prescribed maximum voltage that the laser printer 2000 can output, the V2 is 5.5 kV, the target current I2 represents any of the A, B, or C, and the target current Ith is fixed at −10 μA.

Specifically, the "b" is (I2−Ith)/(V2−Vmax). In the present embodiment, the Ith, V2, and Vmax are fixed, while the target current Ic in the constant current region is any of A, B, or C. Therefore, the value of the "b" will also change depending on which of the A and B is selected.

The Vomax represents the transfer voltage V0 which is indicated when the transfer current is 0, if the slope "b" is extended in the direction of the X-axis. Therefore, Vomax will also changes depending on which one among A and B is selected.

In FIG. 4, the value of target current 12 is the same as for the aforementioned 12. Accordingly, if the A has been selected, the target current 12 when the transfer voltage V0 is the second prescribed value V2 (in the example in FIG. 4, 5.5 kV) will be −12 μA. The Vmax is 6.5 kV in FIG. 4.

The current charging the recording medium will flow sufficiently when the transfer voltage V0 exceeds the second prescribed value V2. However, when the resistance of the recording medium is increased, the transfer voltage V0 exceeds the Vmax greatly if the constant current control is performed. Accordingly, the formula 2 indicates that the target current Ic is controlled to be decreased as the detected transfer current I0 is closed to the Vmax.

The target current Ic that does not match precisely the target current Ic calculated by Formula 2 may be utilized. Furthermore, the Formula 2 may be not necessarily utilized. For example, an adjusted Formula 2 can be utilized, or another formula can be utilized.

Note that when the target current Ic in the constant current region is below the prescribed current Ith (for the C in FIG. 4), the target current Ic will not be changed even if the transfer voltage V0 exceeds the transfer voltage V2. Even if the resistance of the recording medium is increased, the transfer voltage V0 does not exceed the Vmax greatly. In addition, since Vmax is the largest value that the laser printer 2000 can output, after the transfer voltage V0 reaches the Vmax for any one of the A, B, or C, the constant voltage control is performed.

Figure 5:
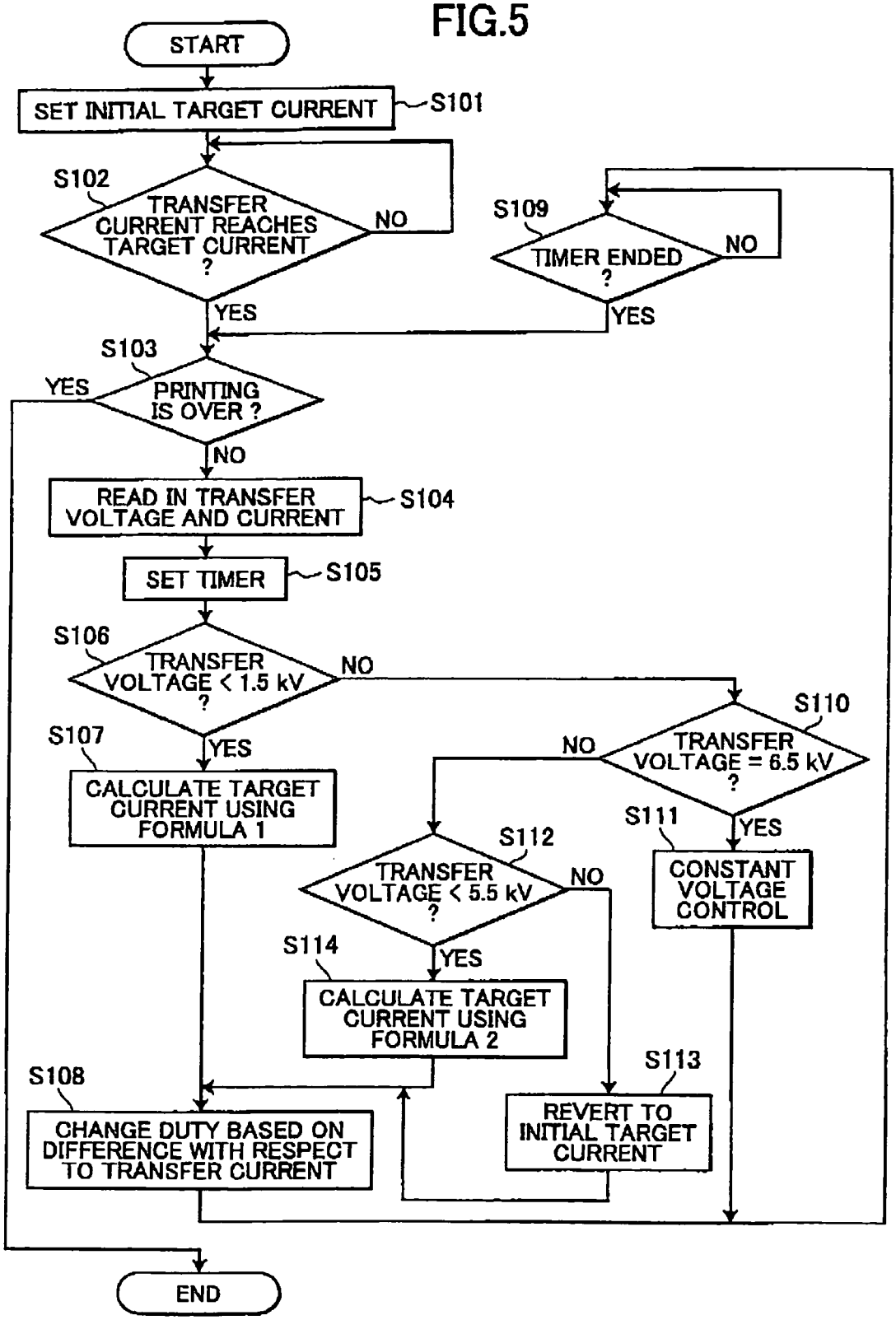
FIG. 5 is a flowchart showing the transfer condition control processing by the CPU 100.

Next, the processing of the CPU 100 that performs transfer condition control in the present embodiment will be described referring to FIG. 5. FIG. 5 is a flowchart of the processing of the CPU 100. Upon the starting of the processing, the CPU 100 sets any of the A, B, or C in FIG. 4 as the target current Ic (S101) based on, for example, the specified paper size and consistency. The target current Ic may be selected either manually or automatically.

The CPU 100 determines whether the transfer current V0 detected by the transfer current detector 150 has reached the target current Ic while controlling the transfer voltage V0 corresponding to the target current Ic (S102). When the transfer current I0 has not reached the target current Ic (S102: NO), the CPU 100 determines continuously whether the transfer current I0 has reached the target current Ic.

When the transfer current I0 has reached the target current Ic (s102: YES), then the CPU 100 determines whether printing has ended (S103). When printing has ended (S103: YES), the processing of the CPU 100 ends. When printing has not ended (S103: NO), the CPU 100 reads in the transfer voltage V0 detected by the transfer voltage detector 106 and the transfer current I0 detected by the transfer current detector 105 (S104), and sets a timer for control (S105). The value to which the timer is set can be determined freely based on the laser printer 2000's specifications.

Next, the CPU 100 determines whether the transfer voltage V0 has dropped below the first prescribed value V1 (1.5 kV) (S106). When the transfer voltage V0 has dropped below 1.5 kV (S106; YES), then the CPU 100 calculates the target current Ic using the aforementioned Formula 1 (S107), and changes the pulse duty of the PWM signal in accordance with the difference between the calculated target current Ic and the detected transfer current I0 in order to match the transfer current I0 with the target current Ic (S108). Then, the CPU 100 determines whether the timer has finished counting the value set at S105 (S109). When the timer has finished counting the value set at S105 (S109: YES), the CPU 100 returns to step S103. When the timer has not finished counting the value set at S105 (S109: NO), the CPU 100 determines continuously whether the timer has finished counting the value set at S105.

In step 106, when the detected transfer voltage V0 is 1.5 kV or greater (S106: NO), the CPU 100 determines whether the transfer voltage V0 has reached the maximum voltage (Vmax. 6.5 kV) (S110). When the transfer voltage V0 has reached the maximum voltage (Vmax: 6.5 kV) (S110: YES), the CPU 100 switches the control method from the constant current control to the constant voltage control since the transfer voltage V0 cannot be raised any higher due to the laser printer 2000's specifications (S111).

When the transfer voltage V0 has not reached 6.5 kV (S110: NO), the CPU 100 determines whether the transfer voltage V0 has exceeded the second prescribed value V2 (5.5 kV) (S112). When the transfer voltage V0 has exceeded 5.5 kV (S112: YES), the CPU 100 calculates the target current Ic using the aforementioned Formula 2 (S114), and changes the pulse duty of the PWM signal in accordance with the difference between the calculated target current Ic and the detected transfer current I0 in order to match the transfer current I0 with the target current Ic (S108). Then, the CPU 100 goes to 8109 and S103.

When the transfer voltage V0 has not been exceeded 5.5 kv (S112: NO), the cPU 100 resets the target current Ic to the target current Ic set at S101 (S113). Then, the CPU 100 goes to S108 and S109, since the target current Ic is in the constant region (between 1.5 kV and 5.5 kV). Note that when the target current has never been changed, the CPU goes to S109 without performing the steps of S113 and S108.

As described above, with the present embodiment, the target current Ic is changed flexibly based on the detected transfer voltage V0 and transfer current I0, and the constant current control is performed in order to match the transfer current I0 with the target current Ic. The target current Ic indicates proper current to be flowed between the transfer roller 25 and the photosensitive drum 23 since the current flowing without charging the recording medium is made consideration. Thus, suitable transfer can be performed.

The need to change transfer conditions—that is, the size and consistency of the recording medium, double-sided printing, changes in humidity other changes in environmental conditions which give rise to changes in the state of the recording medium, changes in the transfer roller 25 over time, changes in the photosensitive drum 23 over time, changes in the toner over time, print duty, etc.—manifests itself as the ratio between the transfer voltage V0 and the transfer current I0—i.e., as a variation in resistance. Accordingly, the target current Ic is determined based on a ratio between the detected transfer voltage V0 and the detected transfer current Ic.

Since the formulas are utilized, less resources such as memory are required.

While the invention has been described in detail with reference to the specific embodiment thereof, it would be apparent to those skilled in the art that various changes and modifications may be made therein without departing from the spirit of the invention.

In the above-described embodiment, when the target current Ic is calculated using formulas such as the Formula 1 and the Formula 2. However, it is also possible to determine the target current Ic while referencing a table that maintains the correspondence relationship between the detected transfer voltage V0, transfer current I0, and the target current Ic.

In the above-described embodiment, the constant current control is performed in the constant region. However, the constant voltage control may be performed.

The target voltage Vc may be selected based on the laser printer 2000's specifications, expected conditions, etc. For example, when the slope in FIG. 4 is utilized, the target voltage Vc is calculated below.

When the detected transfer voltage V0 has dropped below 1.5 kv, the target voltage Vc can be determined based on Formula 3 below.

$$Vc=Io\max/(I0/V0-a) \quad \text{(Formula 3)}$$

Here, the same values as those shown in FIG. 4 can be utilized for Iomax and the slope "a". When determining the target voltage Vc as well, for example with A in FIG. 4 being selected, the target voltage Vc can be calculated by applying, in Formula 3, the slope "a" corresponding to the A in FIG. 4. For the slope "a", a fixed value calculated beforehand may be utilized, or the slope "a" can be calculated by appropriately setting the value of I1 described in the aforementioned embodiment to be a prescribed current value. If the detected transfer voltage V0 exceeds 5.5 kV, the target voltage V0 can be determined based on Formula 4 below. The calculation of, for example, Vomax and the slope "b" can be considered equivalent to that described in the aforementioned embodiment.

$$V=V0\max/(1-b\times I0/V0) \quad \text{(Formula 4)}$$

It is also acceptable to maintain the correspondence relationship between the detected transfer voltage V0 and the transfer current I0 in a table, and to determine the target voltage Vc while referencing the table.

The formula to determine the target current Ic or the target voltage Vc is of course not limited to the specific examples described above; based on the environment, conditions, etc., the formulas may be modified as appropriate to determine the target current.

What is claimed is:

1. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit determines the target current based on a ratio between the detected transfer voltage and the detected transfer current.

2. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit determines the target current based only on the detected transfer voltage when the detected transfer voltage falls within a prescribed range between a first prescribed voltage and a second prescribed voltage, and determines the target current based on both the detected transfer voltage and the detected transfer current when the detected transfer voltage is out of the prescribed range.

3. The image-forming device according to claim 2, wherein the control unit maintains the target current at constant when the detected transfer voltage falls within the prescribed range.

4. The image-forming device according to claim 3, wherein the control unit comprises a target current calculation unit including a prescribed formula, wherein the target current calculation unit calculates the target current while applying the detected transfer voltage and the detected transfer current to the prescribed formula.

5. The image-forming device according to claim 4, wherein the control unit determines the target current based on calculation current Ia taken by applying the detected transfer voltage V0 and the detected transfer current I0 to Formula 1 below, $$Ia=Io\max/(1-a\times V0/I0) \quad \text{[Formula 1]}$$

when the detected transfer voltage V0 is below a first prescribed value V1, wherein an X-Y coordinate includes an X-axis indicating the detected transfer voltage V0 and a Y-axis indicating the detected transfer current I0, the "a" indicates a slope of a straight line connecting (0, Iomax) and (V1, I1), wherein Iomax indicates a maximum value of the transfer current I0 capable of being output, I1 indicates the calculation current Ia set when the transfer voltage V0 is the first prescribed value V1.

6. The image-forming device according to claim 4, wherein the control unit determines the target current based on calculation current Ib taken by applying the detected transfer voltage V0 and the detected transfer current I0 to Formula 2 below, $$Ib=Vo\max/(V0/I0-b) \quad \text{[Formula 2]}$$

when the target current Ic in the prescribed range exceeds a prescribed current Ith and the detected transfer voltage V0 exceeds a second prescribed value V2, wherein an X-Y coordinate includes an X-axis indicating the detected transfer voltage V0 and a Y-axis indicating the detected transfer current I0, the "b" indicates a slope of a straight line connecting (V2, I2) and (Vmax, Ith), the I2 indicates the calculation current Ib set when the detected transfer voltage V0 is the second prescribed value V2 and the Vmax indicates a maximum value of the detected transfer voltage V0 capable of being output, and the Vomax is a maximum value of the transfer voltage V0 capable of being output.

7. The image-forming device according to claim 4, wherein the target current calculation unit has a plurality of prescribed formulae and selects one of the plurality of prescribed formulae based on the target current in the prescribed range.

8. The image-forming device according to claim 4, wherein a target voltage calculation unit comprises a plurality of prescribed formulae and selects one of the plurality of prescribed formulae based on the target voltage in the prescribed range.

9. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit comprises a target current calculation unit including a prescribed formula, wherein the target current calculation unit calculates the target current while applying the detected transfer voltage and the detected transfer current to the prescribed formula.

10. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit performs constant voltage control when the detected transfer voltage becomes greater than or equal to a maximum voltage Vmax capable of being output.

11. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit has a table unit indicating the target current corresponding to the detected transfer voltage and the detected transfer current, and determines the target current while applying the detected transfer voltage and the detected transfer current to the table unit.

12. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target voltage applied between the image-bearing body and the transfer unit, and controls the transfer voltage to match the target voltage while adjusting the transfer voltage output from the transfer voltage applying unit, wherein the control unit determines the target voltage based on a ratio between the detected transfer voltage and the detected transfer current.

13. The image-forming device according to claim 12, wherein the control unit maintains the target voltage at constant when the detected transfer voltage falls within a prescribed range.

14. The image-forming device according to claim 13, wherein the control unit comprises a target voltage calculation unit including a prescribed formula, wherein the target voltage calculation unit calculates the target voltage while applying the detected transfer voltage and the detected transfer current to the prescribed formula.

15. The image-forming device according to claim 14, wherein the control unit determines the target voltage based on calculation voltage Vc taken by applying the detected transfer voltage VO and the detected transfer current I0 to Formula 3 below, $$Vc = Io\max/(I0/V0 - c) \quad \text{[Formula 3]}$$

when the detected transfer voltage V0 is below a first prescribed value V1, wherein an X-Y coordinate includes an X-axis indicating the detected transfer voltage V0 and a Y-axis indicating the detected transfer current I0, the "c" indicates a slope of a straight line connecting (0, Iomax) and (V1, I1), wherein Iomax indicates a maximum value of the transfer current I0 capable of being output, and I1 indicates the calculation current Ic set when the transfer voltage V0 is the first prescribed value V1.

16. The image-forming device according to claim 14, wherein the control unit determines the target voltage based on calculation voltage Vc taken by applying the detected transfer voltage VO and the detected transfer current I0 to Formula 4 below, $$Vd = Vo\max/(1 - b \times I0/V0) \quad \text{[Formula 4]}$$

when target current I2 corresponding to the target voltage Vd in the prescribed range exceeds a prescribed current Ith, and the detected transfer voltage V0 exceeds a second prescribed value V2, wherein an X-Y coordinate includes an X-axis indicating the detected transfer voltage VO and a Y-axis indicating the detected transfer current I0, the "b" indicates a slope of a straight line connecting (V2, I2) and (Vmax, Ith), the I2 indicates the calculation current Ib set when the detected transfer voltage V0 is the second prescribed value V2 and Vmax indicates a maximum value of the detected transfer voltage V0 capable of being output, the Vomax is a maximum value of the transfer voltage V0 capable of being output.

17. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target voltage applied between the image-bearing body and the transfer unit, and controls the transfer voltage to match the target voltage while adjusting the transfer voltage output from the transfer voltage applying unit, wherein the control unit determines the target voltage based only on the detected transfer voltage when the detected transfer voltage falls within a prescribed range between a first prescribed voltage and a second prescribed voltage, and the control unit determines the target voltage based on both the detected transfer voltage and the detected transfer current when the detected transfer voltage is out of the prescribed range.

18. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target voltage applied between the image-bearing body and the transfer unit, and controls the transfer voltage to match the target voltage while adjusting the transfer voltage output from the transfer voltage applying unit, wherein the control unit comprises a target voltage calculation unit including a prescribed formula, wherein the target voltage calculation unit calculates the target voltage while applying the detected transfer voltage and the detected transfer current to the prescribed formula.

19. An image-forming device comprising:

an image-bearing body on which a toner image is capable of being bore;

a transfer unit facing the image-bearing body;

a transfer voltage applying unit that applies transfer voltage to the transfer unit so that transfer current flows between the image-bearing body and the transfer unit;

a transfer current detection unit that detects the transfer current;

a transfer voltage detection unit that detects the transfer voltage; and a control unit that determines, based on both the detected transfer voltage and the detected transfer current, target current to be flowed between the image-bearing body and the transfer unit, and controls the transfer current to match the target current while adjusting the transfer voltage output from the transfer voltage applying unit, wherein the control unit comprises a table unit indicating a target voltage corresponding to the detected transfer voltage and the detected transfer current, and determines the target voltage while applying the detected transfer voltage and the detected transfer current to the table unit.

* * * * *